US009624082B1

(12) United States Patent
Provines

(10) Patent No.: US 9,624,082 B1
(45) Date of Patent: Apr. 18, 2017

(54) PRY BAR SLIDING FULCRUM ASSEMBLY

(71) Applicant: Wynn Provines, Vandalia, IL (US)

(72) Inventor: Wynn Provines, Vandalia, IL (US)

( * ) Notice: Subject to any disclaimer, the term of this patent is extended or adjusted under 35 U.S.C. 154(b) by 17 days.

(21) Appl. No.: 15/063,125

(22) Filed: Mar. 7, 2016

(51) Int. Cl.
*B66F 15/00* (2006.01)
*B66F 3/08* (2006.01)
*B25C 11/00* (2006.01)

(52) U.S. Cl.
CPC ..... *B66F 15/00* (2013.01); *B25C 11/00* (2013.01); *B66F 3/08* (2013.01)

(58) Field of Classification Search
CPC ..... B66F 1/00; B66F 15/00; B25C 11/00
USPC ..... 254/37, 27, 25, 26 R
See application file for complete search history.

(56) References Cited

U.S. PATENT DOCUMENTS 148,664 A 3/1874 Buell
166,818 A 8/1875 Shaw
541,531 A * 6/1895 Graves et al. ..... B25C 11/00 254/27
643,512 A * 2/1900 Lubbock ..... B25C 11/00 254/27
765,246 A * 7/1904 Muir ..... B25C 11/00 254/27
785,020 A * 3/1905 Pearson ..... A24D 3/02 19/65 T
900,338 A 10/1908 Wolfe
949,337 A * 2/1910 Trogner ..... B25C 11/00 254/25
1,395,956 A * 11/1921 Gillis ..... E01B 29/26 254/25
1,782,506 A * 11/1930 Henderson ..... B25C 11/00 254/27
2,061,754 A 11/1936 Casey
2,253,100 A 8/1941 Sprague
2,556,343 A 6/1951 Shearer
2,747,835 A * 5/1956 Belgard ..... B25D 1/045 254/26 E
2,776,108 A 1/1957 Sherman
2,907,106 A 10/1959 Lockwood
4,042,210 A 8/1977 Feldmann
6,626,423 B2 * 9/2003 Doswell ..... B66F 3/08 206/349
7,673,848 B1 * 3/2010 Provines ..... B25C 11/00 254/131
2006/0108570 A1 5/2006 Del Favero
2011/0023237 A1 * 2/2011 Simmons ..... B25D 1/045 7/117

* cited by examiner

*Primary Examiner* — Monica Carter
*Assistant Examiner* — Seahee Yoon
(74) *Attorney, Agent, or Firm* — Kevin L. Klug

(57) ABSTRACT

A pry bar sliding fulcrum assembly having a fulcrum and a saddle which slidably mate with a conventional pry bar and which provide a greater force onto a work material than the conventional pry bar alone. The pry bar sliding fulcrum assembly easily and quickly slides away from the work material when a conventional pry bar function is desired and slides toward the work material when an enhanced application force or greater pry bar end displacement is required. The assembly uniquely mates with or is held with the pry bar end whereby the assembly retains a static position relative to the pry bar during use.

4 Claims, 7 Drawing Sheets

PRY BAR SLIDING FULCRUM ASSEMBLY

This application is a divisional of U.S. patent application Ser. No. 13/345,481 and claims priority of U.S. Provisional Patent Application No. 61/431,780, filed Jan. 11, 2011, entitled Pry Bar Sliding Fulcrum Assembly.

BACKGROUND OF THE INVENTION

The art of the present invention relates to pry bars in general and more particularly to a pry bar fulcrum assembly which slidably mounts with and onto a conventional pry bar and allows a user to obtain a greater and a more optimally placed prying force and displacement during use. The slidability of the present art allows the user to slide the fulcrum assembly rearward whereby the pry bar may be utilized in a conventional manner.

Conventional pry bars typically comprise a handle, a lever shaft mounted with said handle, and a broadened or cleft end mounted with said shaft via a bend between said end and said shaft. The present art uniquely fits with the aforesaid conventional pry bars and provides an adjustable fulcrum which allows a user to obtain the optimum leverage onto the object upon which said end is working. The present art is optimally fitted with a pry bar having a rectangular shaft cross section yet in slightly modified form may be utilized with shafts of any cross section.

The embodiments of the present invention comprise a fulcrum having an optimal cross sectional shape, a saddle, and one or more retainers. For all embodiments, the fulcrum has a preferably deep "V" shaped bar mating wall cross section which accommodates pry bars having a plurality of bend angles near the broadened or cleft end. A first and preferred embodiment has a spring saddle which clips with or around the bar of the pry bar allowing the assembly to removably fit with the pry bar. A second embodiment (first alternative embodiment) has a pivoting fulcrum with one or more slide stops which mate with one or more grooves or recesses within the saddle whereby the fulcrum may pivot and lock into a position. A third embodiment (second alternative embodiment) has a pivoting fulcrum and a proximal extension to said fulcrum having one or more fulcrum holes, said fulcrum being proximally retained via a pin by an aft saddle with one or more holes. The third embodiment (second alternative embodiment) further has one or more positioning holes through which a positioning pin is placed and provides a stop or pivoting offset to the fulcrum during use. A fourth embodiment (third alternative embodiment) has a unique rotating fulcrum stop within the fulcrum proper. The fulcrum stop has a multi-faceted polygonal cross section which rotates and allows any selected facet to abut against the lever shaft of the pry bar for a desired fulcrum pivot positioning. A fifth embodiment (fourth alternative embodiment) has a sliding stop which abuts against the lever shaft of the pry bar and is retained within a contoured slot within the fulcrum. The uniquely contoured slot has two or more stop recesses into which an extending member of the sliding stop seats in order to provide the fulcrum pivoting position desired. A sixth embodiment (fifth alternative embodiment) utilizes a unique saddle structure which allows removal and installation of the adjustable fulcrum assembly via a rotating saddle side wall. Although described as a sixth embodiment, the rotating saddle side wall may be utilized with afore described second through fifth embodiments.

For all embodiments, the fulcrum comprises a plate material having two sides and also having a front wall, a rear wall, a bar mating wall, and a surface mating wall. In all embodiments, the bar mating wall has a shape which uniquely mates with the aforesaid pry bar bend between said end and said shaft and the cross section of the pry bar shaft. The at least partially arcuate or "V" shaped form of said bar mating wall provides an optimum fit, retention, or mating of the fulcrum near or at the pry bar end during use. That is, the fulcrum will not have a substantial movement during use as it substantially fits or seats with the pry bar bend or is held by associated elements. Nearest said rear wall, the surface mating wall has a plurality of shapes unique to each embodiment.

All embodiments of the present invention allow a user to impart substantially more tip force to a work area than with traditional pry bars and in a manner which is substantially quicker, more convenient, and versatile than prior art pry bar assist devices. That is, the present art fulcrum places the pivot point location nearer the broadened end of the pry bar which increases the moment arm of the handle and shaft and decreases the moment arm of the broadened end, thereby placing a greater force upon the broadened end relative to the applied handle force. Furthermore, the present art provides a greater range of displacement at the broadened end due to the fulcrum thickness inserted between the pry bar and the underlying base material. Unique to the present invention is the ability of the fulcrum assembly to quickly and easily slide rearward on the pry bar shaft, while remaining attached, and allow conventional utilization of the pry bar.

Accordingly, it is an object of the present invention to provide a pry bar sliding fulcrum assembly in combination with a conventional pry bar which easily and quickly adjusts to a user's desired position and provides considerably more work force and displacement than conventional pry bars.

Another object of the present invention is to provide a pry bar sliding fulcrum assembly which may be easily and quickly installed and used with conventional pry bars.

A further object of the present invention is to provide a pry bar sliding fulcrum assembly which is easily removed from the work area while remaining attached to a pry bar whereby the pry bar may be utilized in a conventional manner.

SUMMARY OF THE INVENTION

In accordance with the present invention, the first or preferred embodiment represents an adjustable fulcrum assembly comprising a fulcrum having an optimal cross sectional shape and a saddle in the form of a spring clip attached with the fulcrum. The spring clip flexibly fits or secures around the pry bar lever shaft to moveably hold the adjustable fulcrum assembly and pry bar together.

A second or first alternative embodiment pivotally mounts the fulcrum with the saddle, preferably via a pin or other shaft, and utilizes one or more slide stops (a/k/a adjusters or keepers) slidably mounted with said fulcrum and mated with one or more grooves or recesses within said saddle in order to provide a lock or adjustment to the fulcrum rotation or pivot. This locking rotation or pivot allows a greater adjustable distance or separation between the fulcrum and pry bar which may be advantageous in some work situations. The slide stops are preferably spring loaded (i.e. utilize one or more springs) to assure positive retention within said grooves or recesses. Also, said slide stops preferably extend from the sides of said fulcrum whereby they may be disengaged against said spring loading from the grooves or recesses for fulcrum adjustment.

A third or second alternative embodiment has a proximal extension with a fulcrum hole which is held via an aft pin through an aft saddle. The aft saddle has one or more positioning holes through which one or more positioning pins are placed to adjust the separation of the distal fulcrum portion relative to the pry bar. That is, the positioning pins are preferably placed through said position holes above said pry bar lever shaft. This separates the distal portion of the fulcrum from the pry bar, again to allow a greater adjustable distance or separation between the fulcrum and pry bar which may be advantageous in some work situations.

A fourth or third alternative embodiment has a rotating fulcrum stop having a multi-faceted polygonal cross section embedded within a fulcrum cavity with the fulcrum. The rotating fulcrum stop allows each facet to engage or seat against the lever shaft as the fulcrum stop is rotated. This again provides an adjustable separation of the distal portion of the fulcrum from the pry bar. A leaf (or other type of) spring between the saddle and lever shaft provides a force upon the saddle and a screw (preferably thumbscrew) secures the saddle to the lever shaft through a hole in said spring when desired. The rotating fulcrum stop has extending shafts or a fulcrum pin which rotatably fit(s) within fulcrum stop holes within said fulcrum for rotatable retention. Also, a head or knob is preferably attached to said shafts or fulcrum pin to allow for easy rotation of the fulcrum stop.

A fifth or fourth alternative embodiment has a uniquely contoured slot within said fulcrum into which is placed a sliding stop. The contoured slot has one or more stop recesses (preferably arcuate or semicircular in shape) which substantially mate with the sliding stop and again allow adjustable separation of the distal portion of the fulcrum relative to the pry bar. The sliding stop preferably has a broad end and a stop recess mating end. The broad end abuts against the pry bar or lever shaft and the stop recess mating end substantially mates with the one or more stop recesses. Proximal movement of the sliding stop within said contoured slot allows greater fulcrum separation from the pry bar, again to allow a greater adjustable distance or separation between the fulcrum and pry bar which may be advantageous in some work situations.

In all embodiments, the fulcrum portion of the assembly comprises a plate material having two sides and also having a front wall (distally), a rear wall (proximately), a bar mating wall, and a surface mating wall. All embodiments, except for the first or preferred embodiment, also have a pivot hole through which a pin or shaft is placed. The first or preferred embodiment securely attaches the fulcrum with the spring clip via one or more fasteners, screws, pins, or other techniques such as welds or adhesives. All embodiments of the bar mating wall also have a shape which uniquely or substantially mates with the aforesaid pry bar bend between the end and the shaft or the lever shaft. The bar mating wall form provides an optimum retention of the fulcrum near or at the pry bar end during use. For the second through fifth embodiments, nearest the rear wall, the surface mating wall is contoured to allow pivoting or rotational clearance of the fulcrum.

The surface mating wall, alone or in combination with the elements and attributes of the embodiments described, also has an at least partially arcuate form which allows a smooth rotation or pivot of the pry bar when the surface mating wall contacts a base surface relative to which a prying force is imparted upon said broadened end and work material.

In all embodiments, the fulcrum is held with said pry bar via a saddle which mounts or mates over said shaft and is secured with said fulcrum via a retainer such as a pin or bolt or more than one pins or bolts. That is, for the second through fifth embodiments, the fulcrum has a proximal pivot hole through said plate sides nearer said rear wall than said front wall through which a pin or bolt is placed through said saddle and said fulcrum to slidably secure said saddle and fulcrum with said pry bar. For the first embodiment, the fulcrum may be attached to the saddle with welds or other more permanent bonding techniques.

For the second through fifth embodiments, between said saddle and said pry bar shaft is optionally placed a spring, preferably a leaf spring although any type will function. The spring assures and provides a positive mating force or frictional contact between said bar mating wall or saddle and said pry bar. The force assures that the assembly is frictionally held and not loosely mated with the pry bar whereby the assembly will hold at any point when slid.

The present art assembly may be manufactured from a plurality of materials including metallic materials such as steel or aluminum, plastics, composites, woods, and other materials capable of withstanding the compressive and lateral forces of the pry bar. In the preferred embodiment, the assembly is manufactured from a carbon steel.

BRIEF DESCRIPTION OF THE DRAWINGS

Numerous other objects, features, and advantages of the invention should now become apparent upon a reading of the following detailed description taken in conjunction with the accompanying drawings, in which.

DETAILED DESCRIPTION

Figure 2:
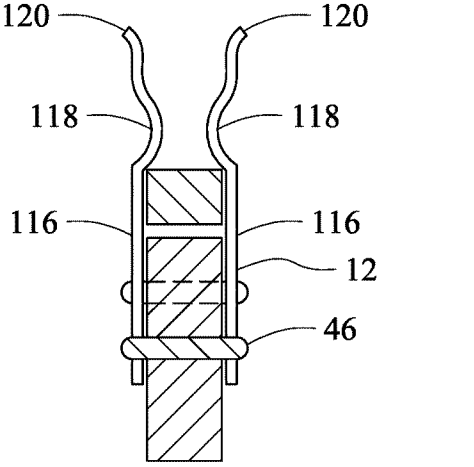
FIG. 2 is a front cross sectional view taken along line 2-2 of FIG. 1 of a first or preferred embodiment of the pry bar sliding fulcrum assembly mounted with a pry bar.
Figure 1:
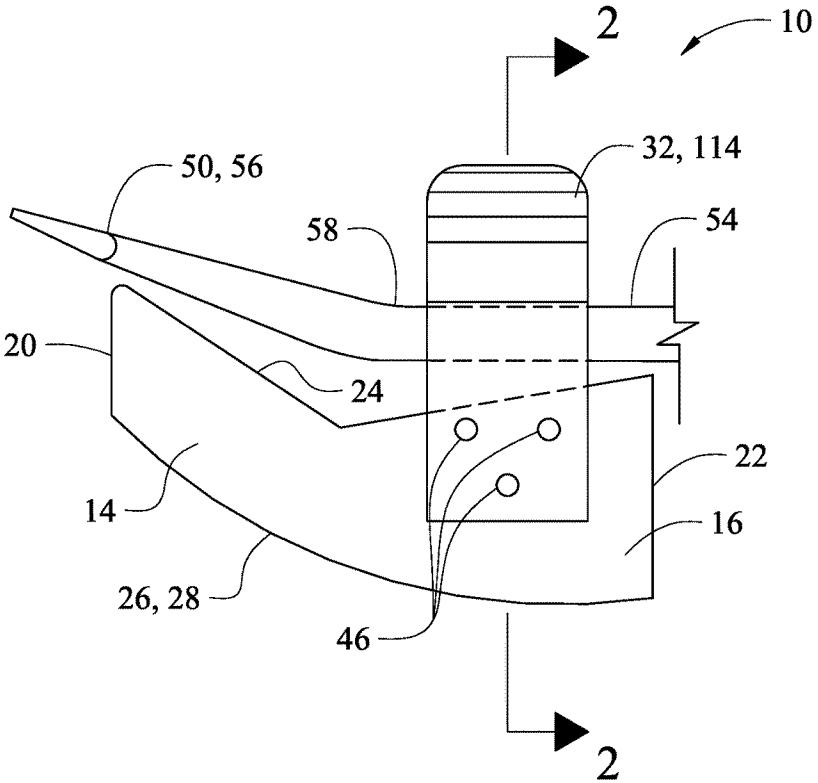
FIG. 1 is a left side plan view of a first or preferred embodiment of the pry bar sliding fulcrum assembly mounted with a pry bar.
Figure 3:
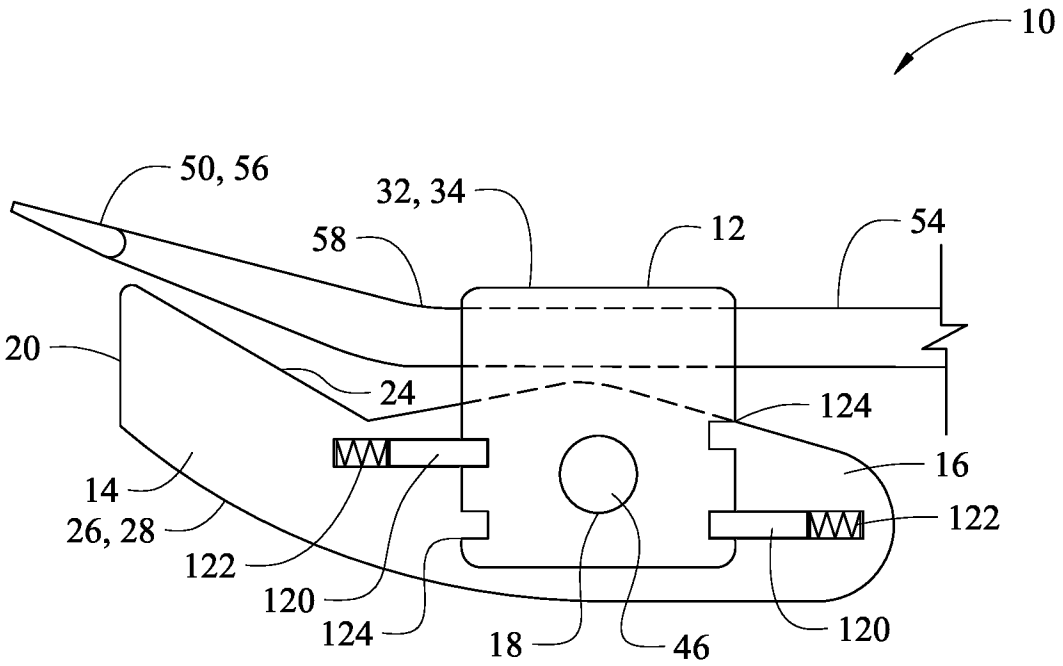
FIG. 3 is left side plan view of a second or first alternative embodiment of the pry bar sliding fulcrum assembly mounted with a pry bar.
Figure 4:
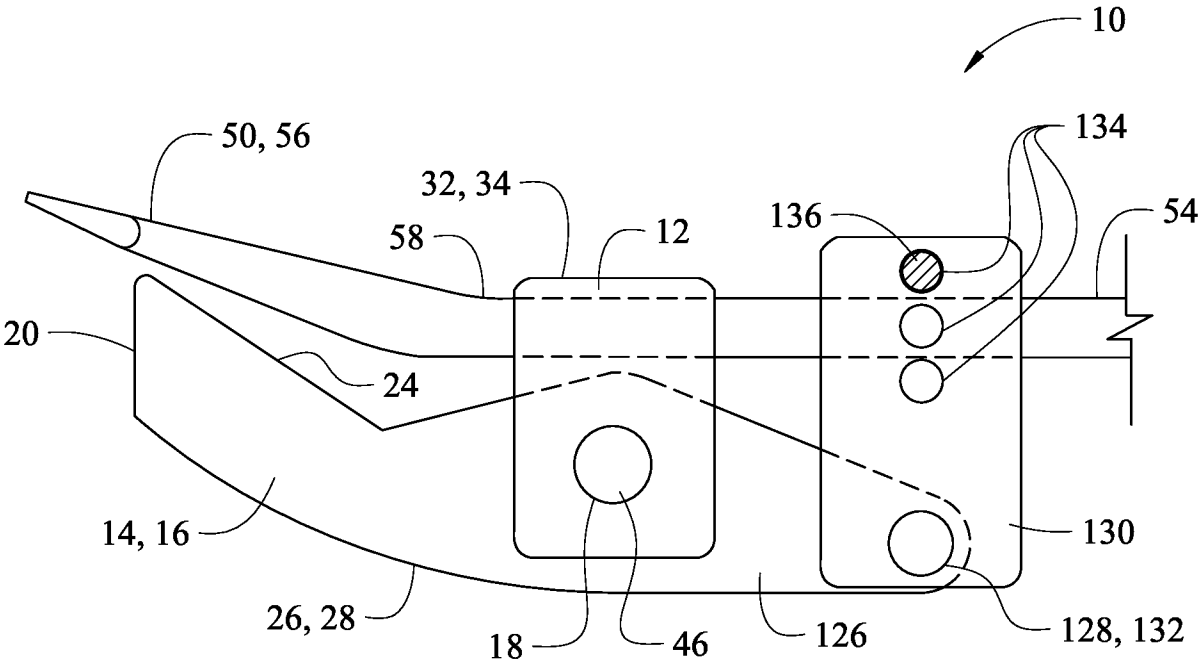
FIG. 4 is a left side plan view of a third or second alternative embodiment of the pry bar sliding fulcrum assembly mounted with a pry bar.
Figure 5:
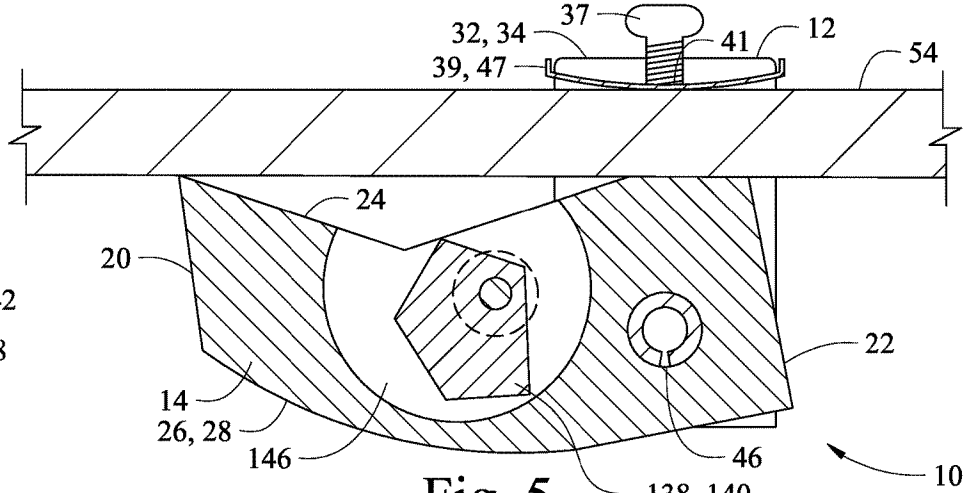
FIG. 5 is a left side plan x-ray view of a fourth or third alternative embodiment of the pry bar sliding fulcrum assembly mounted with a pry bar.
Figure 6:
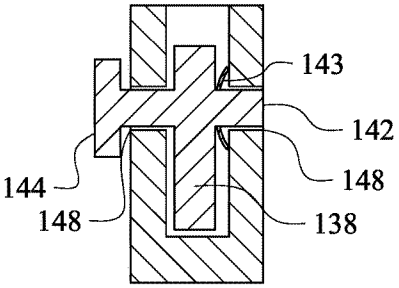
FIG. 6 is a front cross sectional view taken along line 6-6 of FIG. 5 of the fulcrum and rotating fulcrum stop.
Figure 8:
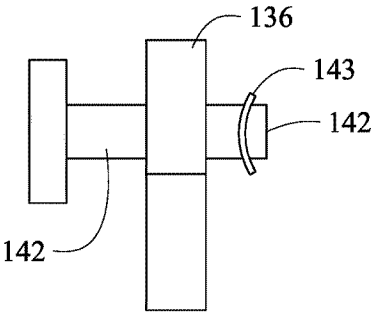
FIG. 8 is a front side plan view of the rotating fulcrum stop of FIG. 5.
Figure 7:
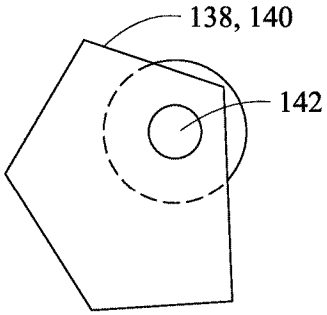
FIG. 7 is a left plan view of the rotating fulcrum stop of FIG. 5.
Figure 9:
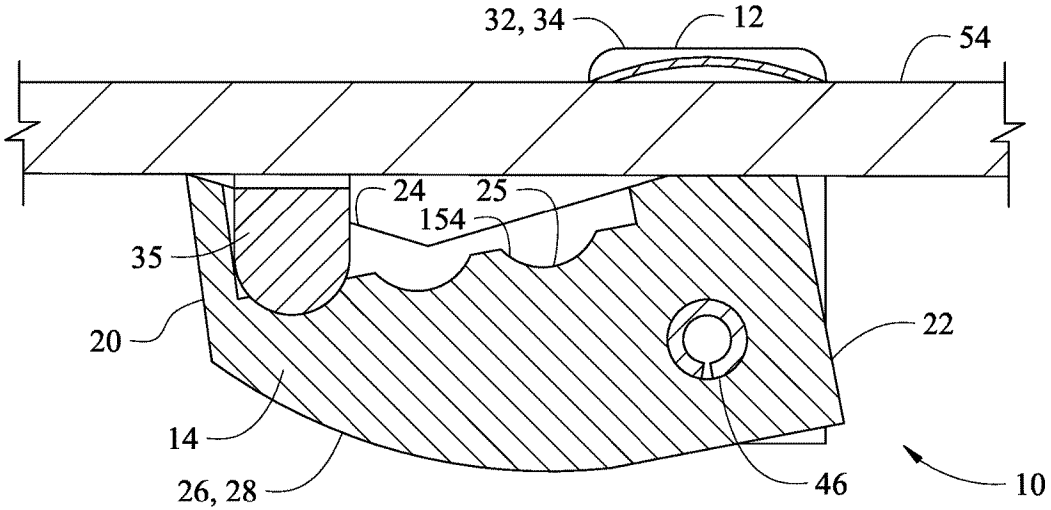
FIG. 9 is a left side plan x-ray view of a fifth or fourth alternative embodiment of the pry bar sliding fulcrum assembly mounted with a pry bar.
Figure 10:
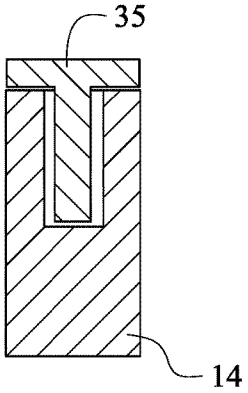
FIG. 10 is a front cross sectional view taken along line 10-10 of FIG. 9 of the fulcrum and sliding stop.
Figure 11:
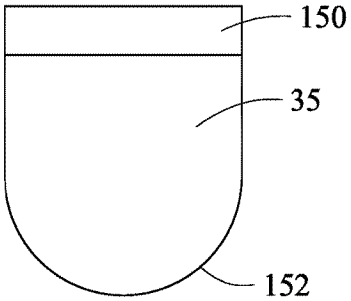
FIG. 11 is a left plan view of the sliding stop of FIG. 9.
Figure 12:
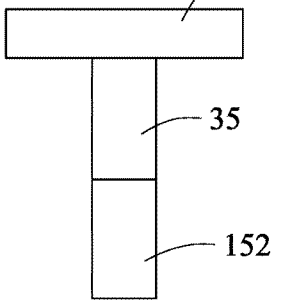
FIG. 12 is a front side plan view of the sliding stop of FIG. 9.
Figure 14:
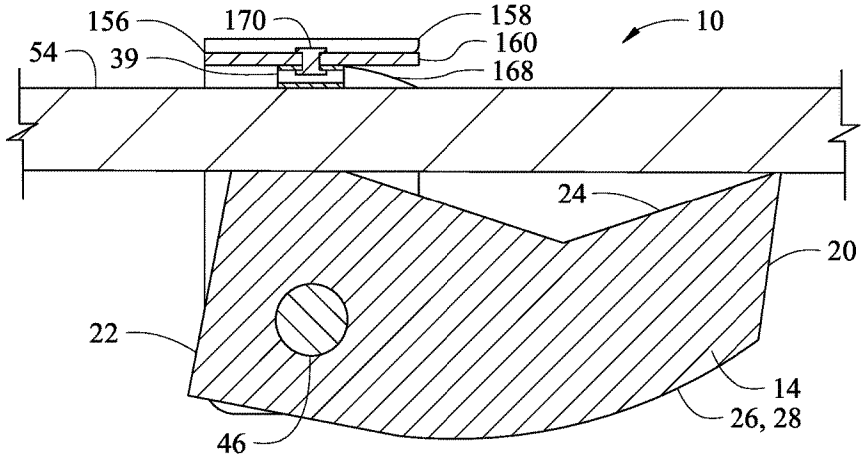
FIG. 14 is a cross sectional view taken along line FIG. 14 of FIG. 13.
Figure 13:
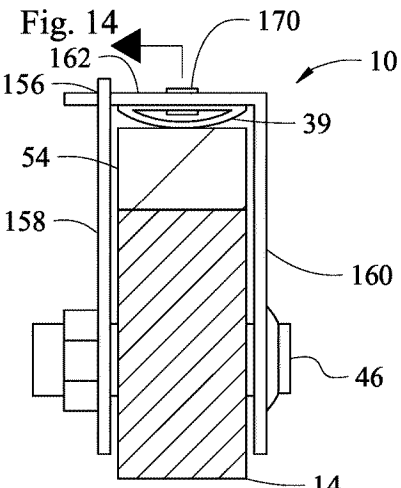
FIG. 13 is a rear plan view of a sixth or fifth alternative embodiment of the pry bar sliding fulcrum assembly mounted with a pry bar and with the pry bar lever shaft in cross section.
Figure 18:
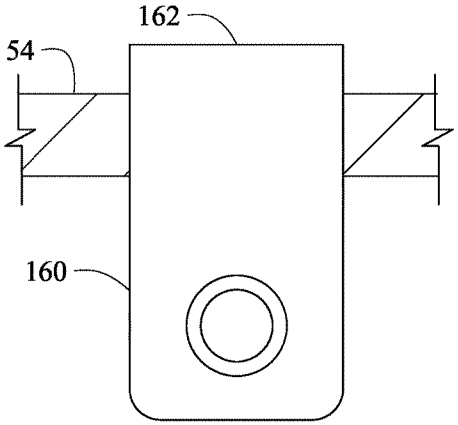
FIG. 18 is a right side plan view of the substantially "L" shaped member of the sixth or fifth alternative embodiment with a lever shaft in the background shown for environment and positioning.
Figure 17:
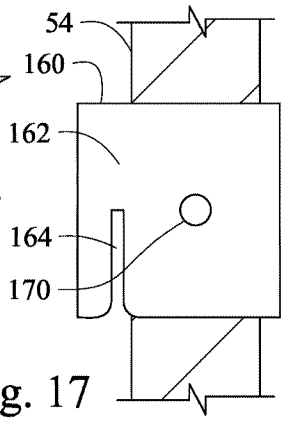
FIG. 17 is a top view of the substantially "L" shaped member of the sixth or fifth alternative embodiment with a lever shaft in the background shown for environment and positioning.
Figure 16:
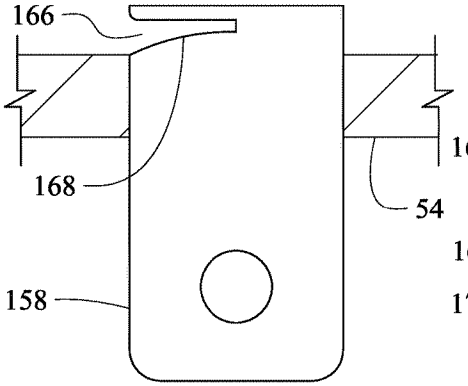
FIG. 16 is a left side plan view of the rotating side wall of the sixth or fifth alternative embodiment with a lever shaft in the background shown for environment and positioning.
Figure 15:
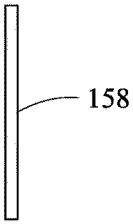
FIG. 15 is a top view of the rotating side wall of the sixth or fifth alternative embodiment.
Figure 19:
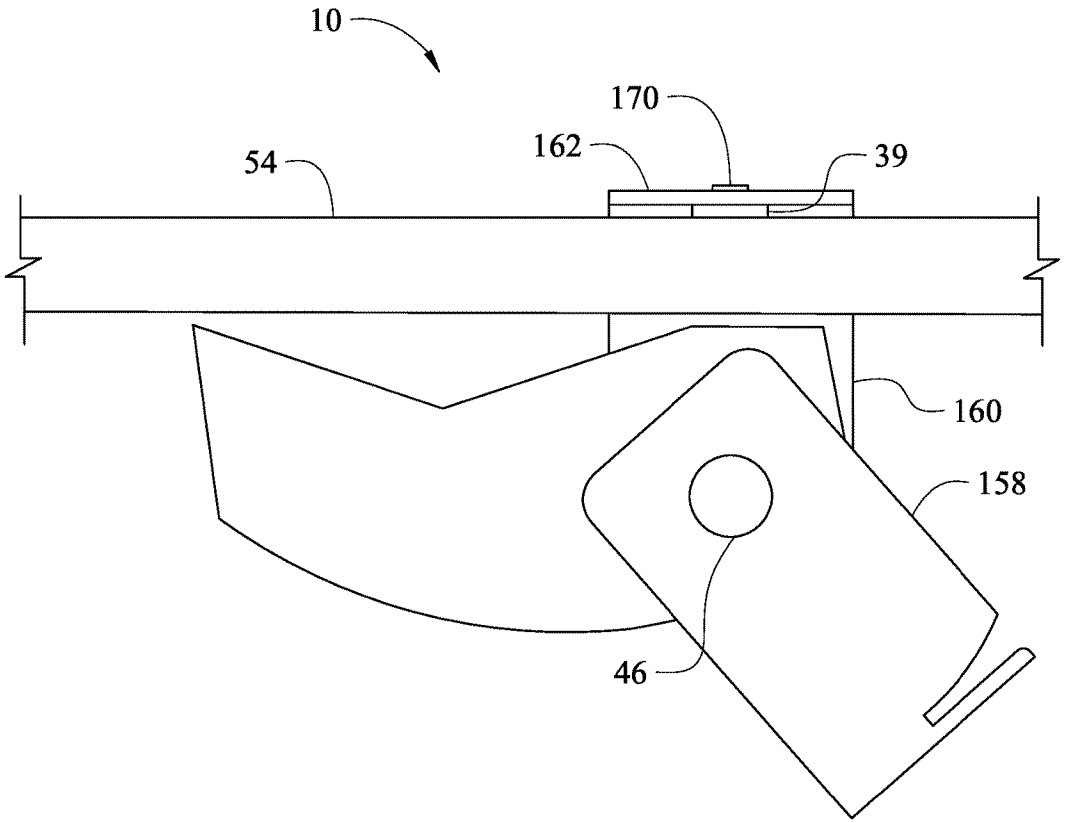
FIG. 19 is a left side plan view of a sixth or fifth alternative embodiment of the pry bar sliding fulcrum assembly mounted with a pry bar and with the rotating side wall in an open or unmated position.

Referring now to the drawings, there is shown in FIGS. 1-2 a first or preferred embodiment of the pry bar sliding fulcrum assembly 10 and in FIG. 3 a second or first alternative embodiment of the pry bar sliding fulcrum assembly 10 and in FIG. 4 a third or second alternative embodiment of the pry bar sliding fulcrum assembly 10 and in FIGS. 5-8 a fourth or third alternative embodiment of the pry bar sliding fulcrum assembly 10 and in FIGS. 9-12 a fifth or fourth alternative embodiment of the pry bar sliding fulcrum assembly 10. The assembly 10 in conjunction with a conventional pry bar 50 allows a user to quickly and easily utilize the combination in order to apply a greater force and/or displacement to a work material than with a conventional pry bar 50 alone.

As recognized within the relevant arts, a conventional pry bar 50 comprises a handle, an end 56 which is typically broadened or cleaved (i.e. having a cleft), a lever shaft 54 between said handle and said end 56, and a bend 58 near or at said end 56. Said bend 58 is often placed onto said shaft 54 close to said end 56 but may also be placed onto the broadened portion of the end 56.

In all embodiments, the fulcrum 14 portion of the assembly 12 comprises a plate material having two sides 16 and also having a front wall 20, a rear wall 22, a bar mating wall 24, and a surface mating wall 26. The second through fifth embodiments also have a pivot hole 18 between the sides 16. The preferred embodiment of the bar mating wall 24 also has a shape or form which uniquely mates with the aforesaid pry bar 50 bend 58 between the end 56 and the shaft 54. The bar mating wall 24 form provides an optimum retention of the fulcrum 14 near or at the pry bar 50 end 56 during use. That is, the fulcrum 14 will not have a substantial movement during use as it substantially seats with and conforms to the pry bar 50 bend 58. In all embodiments nearest the rear wall 22, the surface mating wall 26 is shaped to follow or not interfere with the straight line contour of the pry bar 50 shaft 54. Although the distal portion of the bar mating wall 24 may be described as an arcuate or substantially "V" shaped form, for optimum retention with the preferred embodiment, the bar mating wall 24 has a shape which somewhat mirrors the pry bar 50 bend 58. Unique to the "V" form is the ability of the "V" portion to accommodate pry bars 50 having various bend 58 angles and further minimize pry bar 50 seating or touching at the base or center of the "V" when the bar 50 deflects under use. That is, if the pry bar 50 deflects during use and the surface mating wall 26 has an arcuate form mirroring the pry bar 50 bend 58, i.e. the clearance of the center portion of the arcuate "V" is unavailable, the pry bar 50 will tend to pivot near the center of the arcuate form. The "V" form eliminates this undesirable effect. In all embodiments, the fulcrum 14 may be comprised of two or more laminated plates 31 sandwiched together with retention via welds, crimps, adhesives, rivets or retainers 33 or other types of bonds or may simply comprise a single plate.

The present invention does not required the bar mating wall 24 to have a substantial mirror image of the pry bar 50 bend 58 or intimately conform to the pry bar 50 bend 58 contour. Instead, the bar mating wall 24 is fashioned to seat, although not necessary in an intimate or mirror like form, with the pry bar 50 shaft 54 or pry bar 50 bend 58.

The surface mating wall 26 also has an at least partially arcuate form 28 which allows a smooth rotation or pivot of the pry bar 50 when the surface mating wall 26 contacts a base surface relative to which a prying force is imparted upon a work material via the broadened end 56. An example would be an arcuate form 28 or surface having a partial and approximate four inch radius of curvature surface. In all embodiments, the distance between the surface mating wall 26 and the bar mating wall 24 is greater rearward of the front wall 20 yet not necessarily for all of the fulcrum 14. Alternative embodiments may have varied and different distances between the surface mating wall 26 and bar mating wall 24 than the preferred embodiments which allow an optimum pivot or removal action and further allow an optimum mating between the pry bar 50 and bar mating wall 24.

For the all embodiments, the fulcrum 14 is held with said pry bar 50 via a saddle 32 which mounts or mates over said shaft 54 and is pivotally secured with said fulcrum 14 via a retainer 46 such as a pin or bolt. For the second through fifth embodiments, the fulcrum 14 has a somewhat proximal pivot hole 18 through said plate sides 16 between said rear wall 22 and said front wall 20 through which a retainer 46 is placed through said saddle 32 and said fulcrum 14 in order to slidably secure said saddle 32 and fulcrum 14 with said pry bar 50. Also in said second through fifth embodiments, the saddle 32 comprises an at least partially "U" shaped strap 34 having an interior dimension between the internal legs 36 of said "U" shape which is substantially equivalent to or slightly larger than the pry bar 50 shaft 54 width. The interior dimension must have sufficient tolerance relative to the shaft 54 width whereby the fulcrum assembly 12 may slide on said shaft 54. The fulcrum 14 may also be held to the saddle 32 with welds or other more permanent bonding techniques.

In all embodiments, said front wall 20 transitions between and represents a truncation of the arcuate form(s) 28 of the surface mating wall 26 and the bar mating wall 24. That is, the arcuate form(s) must truncate in order to avoid interference with the pry bar 50 end 56 during use. The position and location of said front wall 20 truncation is dependent upon the shape and size of the pry bar 50. Said front wall 20 may further take a plurality of forms including but not limited to flat, angled, radiused, or recessed cuts of the plate material.

The present art first or preferred embodiment represents an adjustable fulcrum assembly 10 comprising a fulcrum 14 having an optimal cross sectional shape, a saddle 32 in the form of a spring clip 114, and one or more retainers 46, which secure the saddle 32 with said fulcrum 14. Unique to the present first embodiment is the ability of the clip 114 to removably fit in a springing or flexible manner around the lever shaft 54 and frictionally hold at a particular position due to the spring force of the saddle 32. Said spring clip 114 comprises substantially two plate members 116 which form said saddle 32 and attach via said retainers 46 with said fulcrum 14. Each plate member 116 has one or more formed inward protrusions 118 near or at a topmost portion 120 which, when assembled with a pry bar 50, at least partially sandwiches the lever shaft 54 of the pry bar 50 between the fulcrum 14 and said protrusions 118. That is, for the preferred first embodiment, the protrusions have an arcuate shape which the spring force of the spring clip 114 forces a lower quadrant thereof against the lever shaft 54 and thereby provides a perpendicular force which pulls said fulcrum 14 toward said lever shaft 54. As expected, the plate members 116 are preferably manufactured from a spring steel material or any other type of material having elastic memory properties, including but not limited to, any types of metals, plastics, or composites.

The second or first alternative embodiment has one or more sliding stops 120 mounted with said fulcrum 14 which are preferably biased toward said saddle 32 via one or more slide stop springs 122. Within said saddle 32 are one or more grooves or recesses 124 which mate with said sliding stops 120 to hold the fulcrum 14 in a desired position. The fulcrum 14 of this embodiment is pivotally or rotatably retained via a retainer 46 through the pivot hole 18 as described herein. The sliding stops 120 preferably extend through the sides 16 whereby a user may retract said stops 120 and pivotally adjust the fulcrum 14.

The third or second alternative embodiment has the fulcrum 14, saddle 32, and retainer 46 as described with a proximal extension 126 to the fulcrum 14 having one or more fulcrum extension holes 128 for further adjustment. An aft saddle 130 is located proximal from the saddle 32 and has an aft pin 132 there through and pivotally through a portion of said aft saddle 130. (A plurality of other retainer forms or types, i.e. bolts, shafts, etc., may be utilized as said aft pin 132.) The aft saddle 130 has one or more positioning holes 134 through which a positioning pin 136 is placed in order to adjust the pivot position of the fulcrum 14. That is, the positioning pin 136 is generally adjustably placed above said lever shaft 54 or between the "U" of the aft saddle 130 and the lever shaft 54 and as positioned moves the proximal extension 126 toward the lever shaft 54. This action forces a separation of the distal portion of the fulcrum 14 and the lever shaft 54 or broadened end 56. As desired, the positioning pin 136 is relocated to provide the necessary fulcrum 14 pry bar 50 separation.

The fourth or third alternative embodiment has the fulcrum 14, saddle 32, and retainer 46 as described with a rotating fulcrum stop 138 mounted within a fulcrum cavity 146 within the fulcrum 14. The fulcrum stop 138 has a multi-faceted polygonal cross section 140 which rotates and allows any selected facet to abut against the lever shaft 54 or broadened end 56 of the pry bar 50. One or more extending shafts or fulcrum pins 142 extend laterally from said cavity 146 through one or more fulcrum stop holes 148 and a head or knob 144 is attached therewith to allow external rotation of the rotating fulcrum stop 138. As with other embodiments, the rotating fulcrum stop 138 provides the desired or necessary separation of the fulcrum 14. The preferred form of the fourth embodiment has one or more spring, concave, or beveled washers 143 on one or more portions of said extending shafts or fulcrum pins 142 within said fulcrum cavity 146 and between said multi-faceted polygonal cross section portion 140 and one or more walls of said cavity 146. The frictional force of said washer(s) 143 minimize any loose unwanted rotation of the rotating fulcrum stop 138 when not in contact with the pry bar 50, thereby reducing the need for readjustment when selecting a particular facet side, and further minimizing any rattle noise and self-rotation while handling.

In the fourth and fifth embodiments, between the saddle 32 and said pry bar shaft 54 is placed a saddle spring 39. The spring 39 assures and provides a positive mating force between the fulcrum 14 and said pry bar 50. Preferably said spring 39 is of a leaf type but any spring type is usable provided the positive mating force is maintained. The force assures that the assembly 12 is frictionally held and not loosely mated with the pry bar 50 whereby the assembly 12 will hold at any point when slid. Alternative embodiments may replace said spring 39 with magnets, retainers, clamps, set screws, wedges, or other mechanical elements (or combinations thereof) which assure a frictional force between the fulcrum assembly 12 and the pry bar 50 shaft 54. Still further embodiments may utilize a magnetic element between the bar mating wall 24 and the shaft 54 or end 56 or magnetize the fulcrum 14 or the saddle 32 in order to magnetically or frictionally hold the fulcrum 14 with the pry bar 50.

For the fourth and fifth embodiments, said spring 39 is placed between the base of the "U" of the saddle 32 and the shaft 54. That is, the spring 39 compressively tensions the saddle 32 and forces the rotating fulcrum stop 138 or sliding stop 35 into contact with the shaft 54 whereby a frictional contact exists there between. In all embodiments, a frictional contact exists between the saddle 32 ("U" strap 34 in alternative embodiments) and the shaft 54. As with the preferred embodiment, the alternative embodiment may utilize springs 39 which include but are not limited to coil, leaf, or torsional types.

The fourth embodiment has a saddle set screw 37 (preferably a thumbscrew) threaded with the saddle 32 in order to retain the saddle 32 in a specific position and also retain the rotating fulcrum stop 138 in position. That is, when tightened, the saddle set screw 37 provides a saddle 32 force substantially perpendicular to the lever shaft 54 thereby increasing the friction between the fulcrum assembly 12 and the lever shaft 54. Further alternative embodiments may utilize elements distinct from a setscrew 37 in order to provide said force. These include but are not limited to pins, cams, levers, or wedges. Any of the second through fifth embodiments may utilize the saddle set screw 37 or spring 39.

For the fourth embodiment, the saddle spring 39 positioned between the saddle 32 and the lever shaft 54 is retained by a saddle set screw 37 via a retention hole 41 within the saddle spring 39 and/or one or more lips 47 positioned at least partially around the saddle 32 edges. The saddle spring 39 further serves to provide a part or all of the aforesaid force without the need for saddle set screw 37 tightening. The saddle spring 39, via the force imparted, further provides the desired frictional interface between the fulcrum assembly 12 and the pry bar 50 in order to limit any undesired assembly 12 movement. Further alternative embodiments may utilize only a set screw 37 or a saddle spring 39 in lieu of both.

For the second through fourth embodiments, the bar mating wall 24, when seated with said bend 58, at or aft of said proximal pivot hole 18 or retainer 46 (i.e. between said retainer 46 and rear wall 22) have a gap between said shaft 54 and said bar mating wall 24. The gap allows said fulcrum 14 to pivot on said retainer 46 and relative to said saddle 32 when the assembly 12 is retracted from the bend 58 portion. If a gap was not present, the bar mating wall 24 nearest said rear wall 22 would bind with the shaft 54 and preclude sliding of the assembly 12.

The fifth embodiment has a bar mating wall spacer or sliding stop 35 positioned within a contoured slot 154 of the fulcrum 14 between the fulcrum 14 and the lever shaft 54 or the broadened end 56 in order to provide a greater separation distance between the surface mating wall 26 and the lever shaft 54 or broadened end 56. The stop recesses 25 as shown are semicircular in shape but may take a plurality of forms including but not limited to "V", "U", triangular, and rectangular shapes. The bar mating wall spacer or sliding stop 35 preferably has a broad end 150 which abuts against the lever shaft 54 and a stop recess mating end 152 which substantially mates with the one or more stop recesses 25. This fifth embodiment provides a range of displacement at the broadened end due to the inter-disposition of the sliding stop 35 between the pry bar 50 and the fulcrum 14. This geometric form allows a greater pivot angle of the fulcrum 14 on the retainer 46 and a greater separation of the bar mating wall 24 and the lever shaft 54 or broadened end 56 whereby the spacer 35 may be inserted there between. The spacer or sliding stop 35 may further be magnetized in order to assure retention when utilized or stowed.

The sixth embodiment (fifth alternative embodiment) comprises a saddle 32 and fulcrum 14 combination as similarly described in prior embodiments with a unique rotating side wall 158 which aids in removal and installation of the adjustable fulcrum assembly 12. For the sixth embodiment, instead of the saddle 32 comprising a substantially single piece partially "U" shaped strap 34, the saddle 32 is comprised of a two piece assembly 156 which further comprises a substantially "L" shaped member 160 which mates with the rotating side wall 158 to form the saddle 32 "U" shape. The extending portion 162 (i.e. extending leg of the "L") of the "L" shaped member 160 forms the base of the "U" of the "U" shaped strap 34 and has one or more strap slots 164 into which the rotating side wall 158 seats and is secured to form the saddle 32. In a preferred form, the rotating side wall 158 also has one or more wall slots 166 which mate with said strap slot(s) 164 whereby a positive coupling, mating, or retention is formed. The strap slot(s) 164 preferably has a radius portion 168 which allows the rotating side wall 158 to clear the "L" shaped member 160 as the portions 158, 160 are mated.

The side wall 158 rotates upon the retainer 46 securing the fulcrum 14 with the saddle 32. Said retainer 46 may be more permanently mounted with the "L" shaped member 160 via established techniques, including but not limited to welds, crimps, press fits, and adhesives, or may float with said "L" shaped member 160. The side wall 158 is rotatably held with said retainer 46 via established techniques including but not limited to pins, screws, bevels, crimps, or nuts. The sixth embodiment also has a saddle spring 39 which preferably has the cross sectional form of a "D" shape and is secured by a saddle spring retainer 170 which may take a plurality of forms including but not limited to rivets, pins, screws, or bolts. Preferably, the flat of the "D" abuts against the extending portion 162 of the "L" shaped member 160. The saddle spring 39 similarly functions and performs as with prior embodiments. That is, it provides a bias on the assembly 12 in order to limit unintended movement and retain the assembly 12 at a desired position.

In operation, the user slides the fulcrum assembly 12 towards the pry bar 50 end 56 in order to position the assembly 12 for use. For the sixth embodiment the assembly 12 is first installed onto the lever shaft 54 by placing the extending portion 162 of the "L" shaped member 160 over the lever shaft 54 and rotating the side wall 158 into mating contact therewith. For the first or preferred embodiment, the bar mating wall 24 is seated with the pry bar 50 bend 58 whereby it remains substantially stationary during use. For the remaining embodiments, the user positions the assembly 12 near the end as desired and, as afore described, secures the fulcrum 14 into a desired pivotal position. For the fifth embodiment, the user positions the assembly 12 near the end as desired and inserts the bar mating wall spacer or sliding stop 35 between the fulcrum 14 and the lever shaft 54 or end 56 and within said contoured slot 154 and into a bar mating wall recess 25. If desired or necessary, a saddle set screw 37 is then tightened to secure the assembly 12. The user then places the surface mating wall 26 onto the work surface, positions the pry bar 50 end 56 onto the work, and applies a force onto the handle. When finished, the user may retract the fulcrum assembly 12 toward the handle and further utilize the apparatus as a conventional pry bar 50.

The art of the present invention 10 may be adapted to a plurality of pry bar 50 styles and forms, including but not limited to wrecking bars, demolition bars, molding lifters, nail pullers, claw bars, and shingle removers while providing all of the aforesaid benefits.

Although described for enablement purposes, the lengths, widths, and other dimensional attributes may depart significantly from those specified. The shape, size, location, component numbers and mounting methods utilized for each of the components or constituent elements may take a plurality of forms as recognized within the pertinent arts without departing from the scope and spirit of the present invention.

Having described the invention in detail, those skilled in the art will appreciate that modifications may be made to the invention and its method of use without departing from the spirit herein identified. Therefore, it is not intended that the scope of the invention be limited to the specific embodiments illustrated and described. Rather, it is intended that the scope of this invention be determined by the appended claims and their equivalents.

What is claimed is:

1. A pry bar sliding fulcrum assembly comprising:

an adjustable fulcrum assembly comprising a fulcrum and a saddle; and said fulcrum having sides, a front wall, a rear wall, a bar mating wall, and a surface mating wall having a partially arcuate form; and said bar mating wall having a shape capable of at least partially mating with an arcuate bend near a broadened end of a pry bar; and said saddle having a spring clip form with two legs, said legs having an interior dimension between said legs slightly smaller than a pry bar lever shaft and slidably positionable around the pry bar lever shaft; and said spring clip form capable of removably fitting in a springing manner around said pry bar lever shaft and frictionally holding due to a spring force of said legs on said pry bar lever shaft; and said fulcrum and saddle having one or more retainers which secure said fulcrum with said saddle and allow said fulcrum assembly to slide on the pry bar lever shaft; and said bar mating wall having a gap relative to the pry bar lever shaft whereby said fulcrum assembly may slide from a pry bar handle towards the broadened end of the pry bar, at least partially mate with the bend, and thereafter allow placement of said surface mating wall onto a work surface and a provision of a greater force and displacement of the pry bar broadened end when a force is applied onto the pry bar handle.

2. The pry bar sliding fulcrum assembly as set forth in claim 1, further comprising:

one or more inward protrusions near or at a topmost portion of said spring clip capable of at least partially sandwiching the pry bar lever shaft between said fulcrum and said inward protrusions.

3. The pry bar sliding fulcrum assembly as set forth in claim 2, whereby:

said inward protrusions have an arcuate shape which said spring force of said spring clip forces a lower quadrant against the pry bar lever shaft whereby a perpendicular force is provided which pulls said fulcrum toward the pry bar lever shaft.

4. The pry bar sliding fulcrum assembly as set forth in claim 1, whereby:

said fulcrum or said saddle is magnetized thereby holding said fulcrum with the pry bar.

* * * * *